US005580047A

United States Patent [19]

Shih et al.

[11] Patent Number: 5,580,047

[45] Date of Patent: Dec. 3, 1996

[54] TRAINING DEVICE FOR HITTING A BASEBALL

[76] Inventors: Johnson Shih; Peter Tsai, both of 1F, No. 16, Shi-Jei Street, Hsin-Chu City, Taiwan

[21] Appl. No.: 409,983

[22] Filed: Mar. 24, 1995

[51] Int. Cl.[6] ..... A63B 69/40

[52] U.S. Cl. ..... 273/26 R

[58] Field of Search ..... 273/29 A, 26 R, 273/204, 197 R

[56] References Cited

U.S. PATENT DOCUMENTS

| | | | |
|---|---|---|---|
| 2,616,692 | 11/1952 | Bird | 273/26 R |
| 2,834,210 | 5/1958 | Crelinsten | 273/197 R |
| 4,227,691 | 10/1980 | Lefebuer | 273/26 R |
| 4,575,080 | 3/1986 | Miles | 273/26 R |
| 4,796,885 | 1/1989 | Wright | 273/26 R |
| 4,858,921 | 8/1989 | Eustice | 273/26 R |
| 5,203,558 | 4/1993 | An | 273/26 R |

*Primary Examiner*—Theatrice Brown
*Attorney, Agent, or Firm*—Larson and Taylor

[57] ABSTRACT

A training device for hitting a baseball is disclosed. The device includes a baseboard, an upstanding column, and flexible duct, and a transverse arm. A longitudinal rotary axle is located below the base side of the transverse arm; a rotary axle is inserted into the upper end of the upstanding column; an elastic pad is set in the engaging interface between the rotary axle and the inner wall of the upstanding column, and an engaging pipe for engaging the flexible duct is set above the end of the transverse arm. The transverse arm is rotated around the axle center of the base side, so that a baseball on a bearing disk of the flexible duct can adjust to the preset hitting position within the range of the rotation radius of the transverse arm.

4 Claims, 4 Drawing Sheets

TRAINING DEVICE FOR HITTING A BASEBALL

BACKGROUND OF THE INVENTION

The present invention relates to a training device for hitting a baseball, particularly, to a device for simulating the baseball within the hitting section of the internal angle and external angle of the baseboard.

DESCRIPTION OF THE PRIOR ART

The conventional training device for hitting a baseball, is shown in FIG. 5, in which a upstanding column (2) is longitudinally extended from the middle part of the planar baseboard (1). The height of the upstanding column is adjusted by the adjusting ring (21) on the middle portion thereof, and a flexible duct (3) with proper height is engaged above the upstanding column (2). A bearing disk (31) for bearing baseball (A) is formed on the upper part of the flexible duct (3), and a linkage line is connected between said baseball (A) and said baseboard (1).

In accordance with the structure described above, said baseball is supported at a proper height above the middle part of the baseboard, and the height can be adjusted. The baseballer can hit the baseball above the baseboard at different heights for training. Because a linkage line in the baseball is connected to the baseboard, the baseball only flies within a preset range. From the structure described above, said baseball is supported above the middle part of the baseboard, and the height can be adjusted in the vertical direction, so that the training device for hitting a baseball can not simulate the hitting section within the range of the internal angle and external angle of the baseboard.

SUMMARY OF THE INVENTION

For the reason described hereinabove, a training device for hitting a baseball according to the present invention is provided, wherein a longitudinal rotary axle is formed below the base side of a transverse arm; a rotary axle is inserted on the upper end of an upstanding column; an elastic pad is set in the engaging interface between the rotary axle and the inner wall of the upstanding column; and an engaging pipe for engaging the flexible duct is set above the end of said transverse arm. By the structure described above, the transverse arm is rotated around the axle center of the base side, so that the baseball on the bearing disk of the flexible duct can adjust to the preset hitting position within the range of the rotation radius of the transverse arm, therefore the present invention can simulate the hitting section within the range of the internal angle and external angle of the baseboard.

DESCRIPTION OF THE PREFERRED EMBODIMENT

Figure 1:
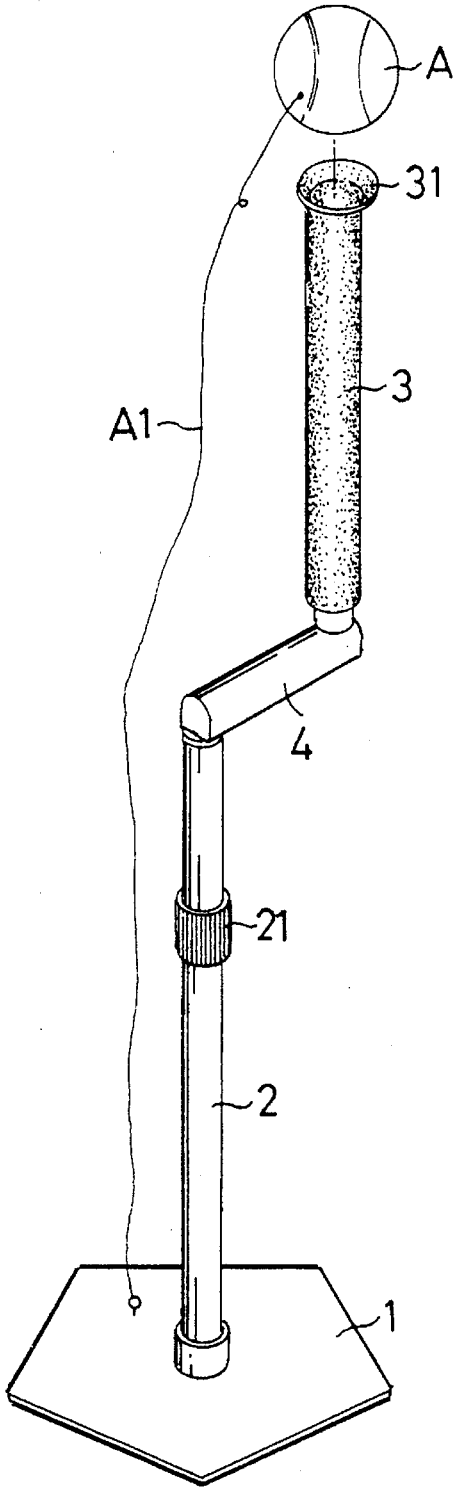
FIG. 1 is a perspective view of the training device for beating baseball according to the present invention.
Figure 2:
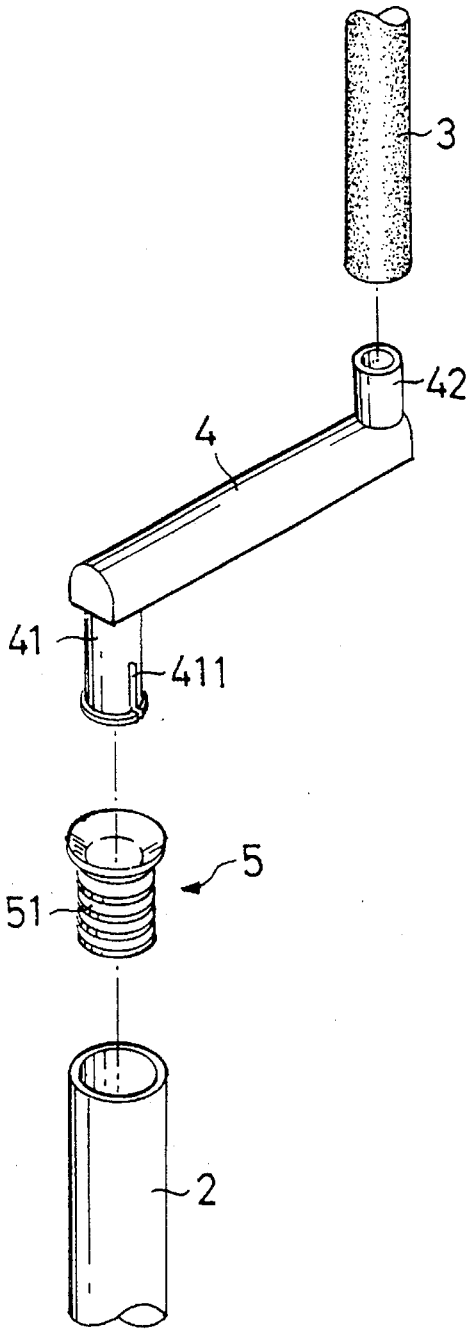
FIG. 2 is an exploded perspective view of an upstanding column, a transverse arm, and a flexible duct.

As shown in the FIGS. 1 and 2, a training device for hitting a baseball according to the present invention comprises a baseboard (1), upstanding column (2), transverse arm (4), and a flexible duct (3). Upstanding column (2) is longitudinal extended from the middle part of the planar baseboard (1), and the height of the upstanding column is adjusted by an adjusting ring (21) on the middle portion thereof.

Furthermore, a transverse arm (4) is mounted on the upper end of the upstanding column (2), and the length thereof is approximately equal to the radius of the baseboard. A longitudinal rotary axle (41) (see FIG. 2) is formed below the base side of said transverse arm (4), the rotary axle (41) is inserted into the upper end of said upstanding column (2). Said transverse arm (4) is rotated around the axle center of the base side, and an engaging pipe (42) for engaging the flexible duct (3) is set above the end of said transverse arm. A longitudinal slit (411) (see also FIG. 4) is formed in the end of the rotary axle (41) in order to have a preferred engagement between upstanding column (2) and the rotary axle (41) thereof. When the rotary axle (41) is engaged with the upstanding column (2), a proper elastic contact between the rotary axle (41) and upstanding column (2) is provided by the slit (411).

Moreover, a flexible duct (3) with proper height is engaged above the engaging pipe (42). A bearing disk (31) for bearing baseball (A) is formed on the upper part of the flexible duct (3), and said flexible duct is made of flexible material, for example, rubber material.

Figure 3:
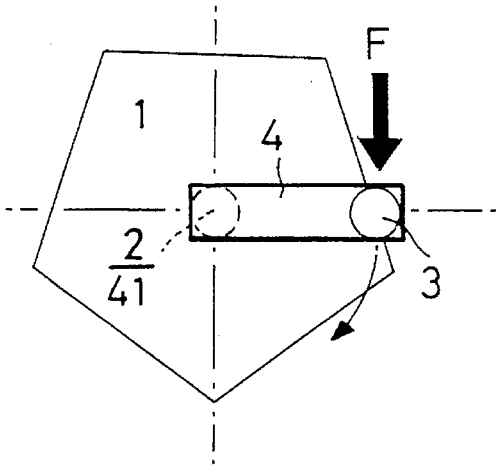
FIG. 3 is a top plan view showing the rotational state of the tansverse arm.
Figure 4:
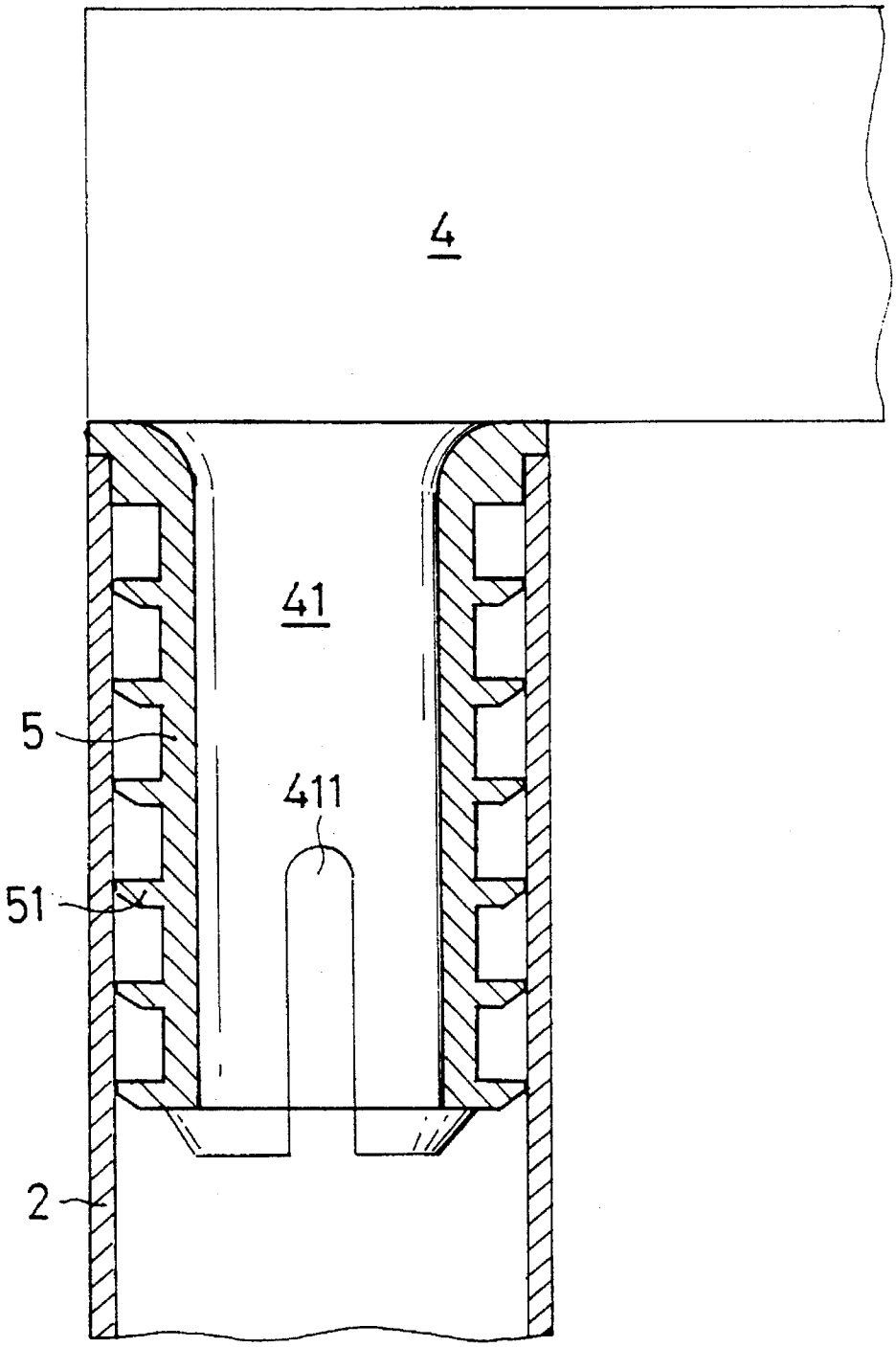
FIG. 4 is a cross-sectional view showing the relationship between a rotary axle of a transverse arm, an elastic pad and an upstanding column.
Figure 5:
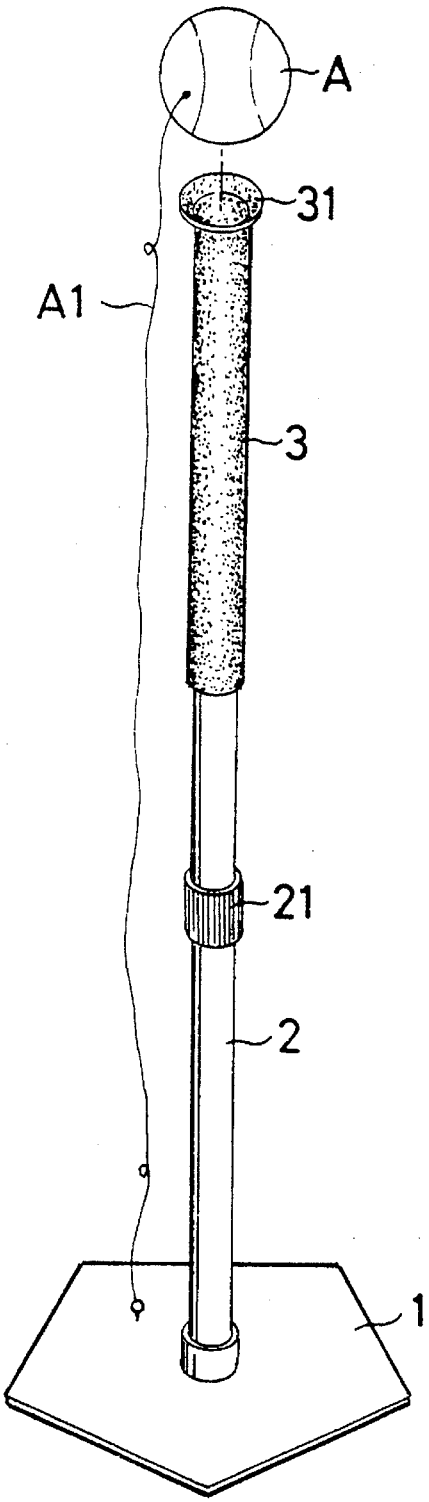
FIG. 5 is a perspective view of a training device for hitting a baseball in the prior art.

A linkage line (A1) in the baseball (A) is connected to the baseboard (1), and thus the baseball only flies within a preset range. By the structure described above, said transverse arm (4) is rotated around the axle center of the base side to a preset position, so that the baseball (A) on the bearing disk (31) of the flexible duct can adjust to the preset hitting position within the range of the rotation radius of the transverse arm (4) by exerting force (F), as shown in FIG. 3. Thus the present invention can simulate the hitting section within the range of the internal angle and external angle of the baseboard. When the baseballer hits said baseball (A), generally, the transverse arm (4) of the training device is maintained in the preset position. If the baseball hit by the baseballer contacts the flexible duct (3), although the flexibility of the flexible duct (3) can absorb some beating force of the baseball, part of the force will transfer to the transverse arm (4). Then the transverse arm (4) rotates rapidly around the upstanding column. It is possible to hurt the baseballer, therefore a resistance is needed for constraining the rapid rotation of the transverse arm (4). For the reason described above, an elastic pad or insert (5) is set in the engaging interface between the rotary (41) axle and the inner wall of the upstanding column (2), as shown in FIGS. 2 and 4. Insert (5) has a plurality of circular elastic ridges (51) contacting with the inner wall of the upstanding column (2). Ridges (51) are formed in the outer circumference of said elastic pad (5) so that the transverse arm is intensely engaged with the elastic pad to create a proper frictional force with rotary axle (41) of the transverse arm by said elastic pad (5), and the rotation thereof is constrained, so the safety of the baseballer is increased.

We claim:

1. A training device for hitting a baseball which comprises a transversely extending baseboard;

an upstanding column having an upper end and a lower end mounted to said baseboard;

a flexible duct;

a transverse arm having a length that is approximately equal to the transverse extent of the baseboard;

a longitudinal rotary axle dependingly mounted to one end of said transverse arm, said rotary axle being mounted to the upper end of said upstanding column so that said transverse arm can be pivotally rotated about said rotary axle;

an elongated engaging member; and means for attaching said elongated engaging member to the other end of said transverse arm and extending vertically therefrom, said flexible duct having one end attached to said engaging member and extending upwardly therefrom and having ball support means at an upper end thereof.

2. The training device for hitting a baseball as claimed in claim 1 wherein a longitudinal slit is formed in other end of said rotary axle.

3. The training device for hitting a baseball as claimed in claim 1, wherein said upstanding column has a tubular upper end and an inner wall; and an elastic insert mounted between said rotary axle and the inner wall of the upstanding column.

4. The training device for hitting a baseball as claimed in claim 3, wherein said insert has a plurality of outer circular elastic ridges, said ridges contacting said inner wall.

* * * * *